US007797986B2

(12) United States Patent
Kinkade, Jr. et al.

(10) Patent No.: US 7,797,986 B2
(45) Date of Patent: Sep. 21, 2010

(54) MAGNETIC FLUID PARTICULATE SEPARATION PROCESS

(75) Inventors: Charles E. Kinkade, Jr., Warren, MI (US); Thomas R. Taylor, Clinton Township, MI (US)

(73) Assignee: SPX Corporation, Charlotte, NC (US)

( * ) Notice: Subject to any disclaimer, the term of this patent is extended or adjusted under 35 U.S.C. 154(b) by 1056 days.

(21) Appl. No.: 11/511,399

(22) Filed: Aug. 29, 2006

(65) Prior Publication Data

US 2008/0067118 A1 Mar. 20, 2008

(51) Int. Cl.
*G01N 15/00* (2006.01)

(52) U.S. Cl. ..... 73/53.07; 73/9

(58) Field of Classification Search ..... 73/53.07
See application file for complete search history.

(56) References Cited

U.S. PATENT DOCUMENTS 4,247,298 A * 1/1981 Rippie ..... 436/2
4,500,839 A * 2/1985 Jones et al. ..... 324/204
6,598,464 B1 * 7/2003 Rossi ..... 73/53.05

* cited by examiner

*Primary Examiner*—Hezron Williams
*Assistant Examiner*—Mark Shabman
(74) *Attorney, Agent, or Firm*—Baker & Hostetler LLP

(57) ABSTRACT

A fluid tester includes an inlet for a fluid path, an ionization chamber defining at least part of the fluid path located downstream from the inlet, a charge chamber configured to subject a fluid to an electric field defining at least part of the fluid path located downstream of the ionization chamber, a patch holder configured to hold a patch into the fluid path downstream of the electric chamber and an outlet for the fluid path. A method of testing a fluid includes ionizing a fluid, moving particles suspended in the fluid by passing the fluid through an electric field, passing the fluid through a patch and analyzing a patch.

16 Claims, 2 Drawing Sheets

MAGNETIC FLUID PARTICULATE SEPARATION PROCESS

FIELD OF THE INVENTION

The present invention relates generally to testing lubricating or hydraulic fluids. More particularly, the present invention relates to a handheld unit for conducting patch tests for analyzing contaminants within lubricating or hydraulic fluids.

BACKGROUND OF THE INVENTION

Fluids such as hydraulic oil and lubrication fluid are used in a variety of machinery. Because these fluids are used in conjunction with moving parts to reduce the wear on those parts and also remove heat, it is important that these fluids be not contaminated.

There are a variety of types of contamination that can occur within lubricating or hydraulic fluid. For example, parts of metal can be worn away from the moving parts and become suspended in the fluid. This is a particularly undesirable situation in that these pieces of metal held in suspension in the fluid can cause additional wear upon parts contacted by the fluid. In addition to suspended particles of metal, lubricating and hydraulic fluid can also become contaminated with water, dirt, organic matter such as bacteria, and other substances that can be found in the system using the lubricating or hydraulic fluid.

To allow equipment to operate at optimal efficiency, the lubricating or hydraulic fluid is filtered and regularly changed to avoid allowing contaminated fluid to be used too long in a system. Changing fluid too often or not often enough will result in equipment down time and expense. Therefore, it is desirable to monitor contamination levels within lubricating and hydraulic fluids in order to change the fluid at optimum times. Today, testing lubrication and hydraulic fluids for contamination can, in some instances, require a fluid sample be sent to a laboratory for analysis. This does not allow technicians onsite to quickly identify issues on equipment that is being tested or serviced in the field. Nor does it allow technicians to determine on the spot whether the lubricating and hydraulic fluid needs replacing.

There are patch tests currently being used but the patch, itself, is analyzed by a laboratory in yielding the same drawbacks as when the fluid samples themselves are sent for analysis to laboratories. Some on the spot fluid testing may be accomplished by systems in the field using lasers and other expensive technology to analyze the fluid. While these systems may provide on the spot analysis they are prohibitably expensive for many applications.

As a result, for many of the above mentioned applications, if not most applications, these sorts of testing units are so expensive or time consuming so as to be not used as effective field testers. Accordingly, it is desirable to provide a method and apparatus that permits field testing of fluids to determine whether the fluid needs to be replaced in a compact, portable, relatively inexpensive, and easy to use way.

SUMMARY OF THE INVENTION

The foregoing needs are met, to a great extent, by the present invention, wherein in one aspect, a method and apparatus is provided that permits field testing of lubricating or hydraulic fluid to determine whether the fluid needs to be replaced in a compact, portable, relatively inexpensive, and easy to use way.

In accordance with one embodiment of the present invention, a fluid tester is provided. In some embodiments of the present invention, the fluid tester includes an inlet for a fluid path, an ionization chamber defining at least part of the fluid path located downstream of the inlet, a charge chamber configured to subject a fluid to an electric field defining at least part of the fluid path located downstream of the ionization chamber, a patch holder configured to hold a patch into the fluid path downstream of the charge chamber, and an outlet for the fluid path.

In accordance with one embodiment of the present invention, a fluid tester is provided. In some embodiments, the fluid tester includes means for inletting a fluid into a fluid path, means for ionizing fluid located downstream of the inletting means, means for creating an electric field in the fluid path located downstream of the ionizing means, means for holding a patch configured to hold a patch into the fluid path downstream of the means for creating an electric field, and means for outletting fluid from the fluid path.

In accordance with another embodiment of the present invention, a method of testing a fluid is provided. In some embodiments, the method includes ionizing a fluid, moving particles suspended in the fluid by passing the fluid through an electric field, passing the fluid through a patch, and analyzing the patch.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
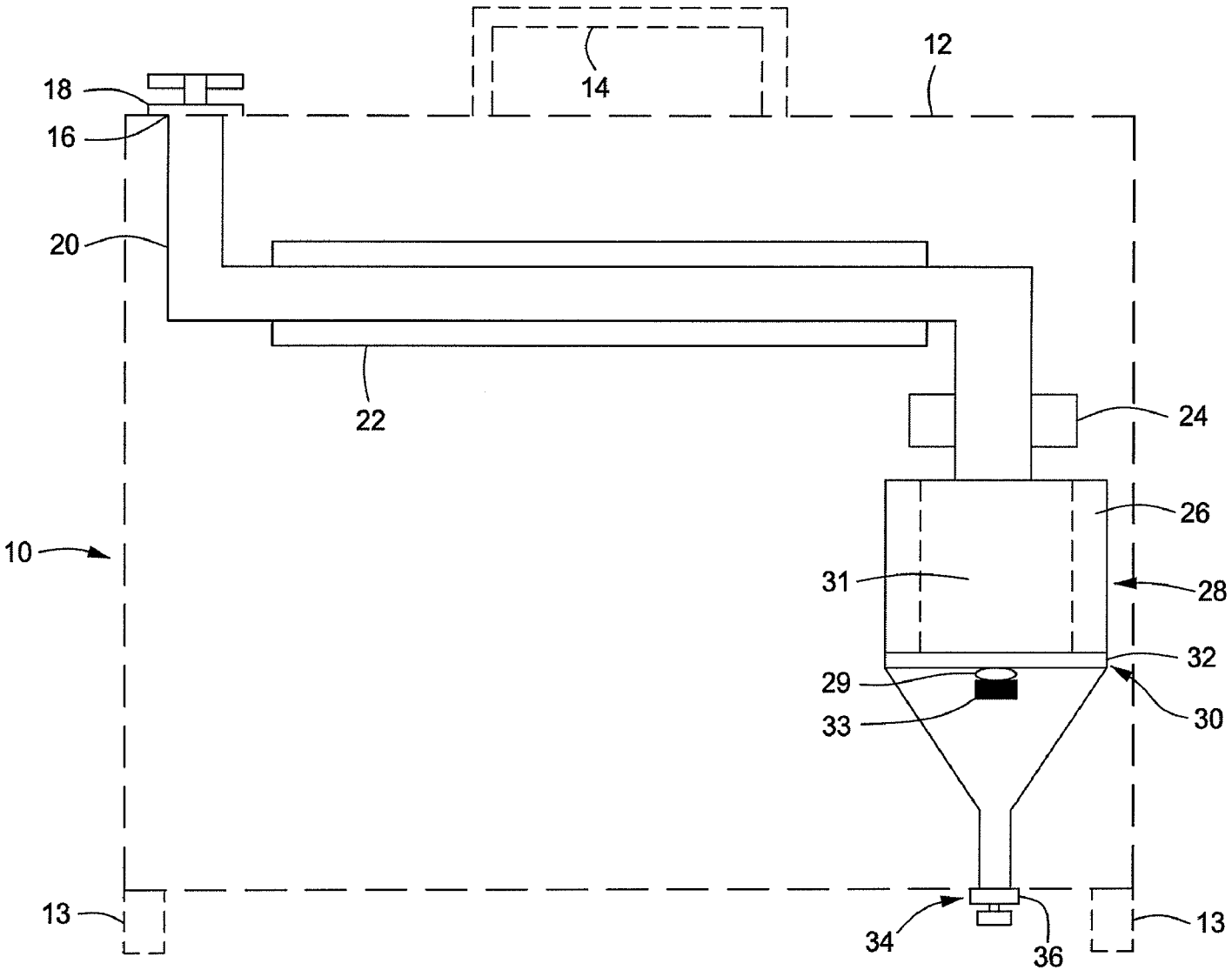
FIG. 1 is a side view illustrating a handheld fluid testing apparatus according to an embodiment of the invention.

The invention will now be described with reference to the drawing figures, in which like reference numerals refer to like parts throughout. An embodiment in accordance with the present invention provides a fluid tester 10 as shown in FIG. 1. The fluid tester 10 is portable and is contained within a case or housing 12. The housing is equipped with feet 13 which are able to support the weight of the tester 10 when set down on the ground, floor or other object.

In some embodiments of the invention, there are four feet 13. The case 12 in some embodiments of the invention is equipped with a handle 14. The handle 14 can be fixed or may be pivoted so that it can swing out of the way when not in use. At the top end of the case 12 is an inlet 16. The inlet 16 is covered with an inlet cap 18. The inlet cap 18 is removably fixed to the inlet 16. The inlet cap 18 may be fixed to the inlet 16 by threads, by a snap fit connection or any other suitable way for fixing the inlet cap 18 to the inlet 16. The inlet 16 exposes a fluid path 20. The fluid path 20 permits the lubricating or hydraulic fluid to be tested to flow through the tester 10 and provides a path for the fluid to flow in the desired manner.

Along the fluid path 20 after the inlet is an ionization chamber 22. The ionization chamber 22 is configured to ionize the fluid. The fluid may be ionized in the ionization chamber 22 in any suitable manner. In some embodiments of the invention, the ionization of the fluid in the ionization chamber 22 may be accomplished by exposing the fluid to high voltage. In other embodiments, the fluid is exposed to static electric charge or ultraviolet radiation to ionize the fluid in the ionization chamber 22.

After the fluid has flown through the ionization chamber 22 and has been ionized, it continues down the fluid path 20. In some embodiments of the invention, to facilitate fluid flowing through the fluid path 20, in the desired direction and at the desired pressure and speed, a pump 24 is used.

In some embodiments of the invention, the pump 24 can be an electric pump or can be a hand-operated pump. The pump is sized sufficiently and selected by one skilled in the art to generate enough pressure to flow lubricating or hydraulic fluid, and in instances where a diluting fluid is added to the lubricating or hydraulic fluid, to facilitate the lubricating or hydraulic fluid and solvent fluid combination through the patch 30.

The pump 24 can be placed between the ionization chamber 22 and the charge chamber 28 as illustrated in FIG. 1. In other embodiments of the invention, the pump 24 can be placed any where along the fluid path 20 that will provide suitable pressure for allowing the fluid to flow through the fluid path 20. Still other embodiments may include a tester 10 where the fluid is gravity fed.

The charge chamber 28 is equipped with charged walls 26. The charged walls 26 are in some embodiments negatively charged. In some embodiments of the invention, the walls, themselves, are not charged but the charge chamber 28 is subjected to an electric field. In embodiments where the walls 26 themselves are not charged, the walls 26 form an outer physical boundary to an electric field.

In some embodiments of the invention, a charge plate 29 is located on the other side of the path 30 from the main portion 31 of the charge chamber 28. The charge plate 29 has an opposite charge as the charged walls 26. As the charge plate 29 is located near the center of the charging chamber 28, the charge plate 29 will assist in causing charged particles in the fluid to move to either the center of the walls of the charging chamber 28 according to the charge of the particles.

The electric field may be provided by a current supplied by a battery located in the tester 10 to the charged walls 26 and the charge plate 29. In embodiments having negatively charged walls 26 and a positively charged plate 26, atoms in the fluid that have been positively charged in the ionization chamber 22 will be drawn toward the negatively charged, walls 26 of the electric chamber 28 and vice versa for embodiments having positively charged walls and a negatively charged plate 29. As mentioned above, the charged walls may not actually be charged but defined an outer edge of an electric field that particles in the fluid can go.

Material that is not charged positively or negatively will be located randomly in the fluid in the charge chamber 38. In embodiments where the walls 26 are negatively charged, any material that is negatively charged will be repelled from the charged walls 26 and attracted to the positively charged charge plate 29 and will have a tendency to move towards the middle of the charge chamber 28. As the fluid moves through the charge chamber 28 and the particles within the fluid that are positively or negatively charged will be moved to the respective areas as biased by the electrical field within the charge chamber 28.

In addition to charged walls 26, and a charge plate 29, to influence particles in the fluid, some embodiments of the invention will also have a magnet 33. The magnet 33 will in some embodiments, and as shown in FIG. 1, be located in the middle of the charge chamber 28 near the charge plate 29 and on the opposite side of the patch 30 from the main portion 31 of the charge chamber 28. In other embodiments of the invention, the magnet may be located in a position other than near the center as shown and described. The magnet will attract Ferris particles, thereby causing Ferris materials suspended in the fluid to move to where the magnet 33 is. In embodiments where the magnet 33 is located in the center of the charge chamber 28 as shown in FIG. 1, the Ferris materials will move toward the center of the charge chamber 28.

After the fluid has flown through the main portion 31 of the charge chamber 28, it will continue along the fluid path and encounter a patch 30. The patch 30, in some embodiments of the invention, is a standard patch used in patch tests for testing lubrication fluids. In some embodiments of the invention, the patch 30 will filter particles five microns in diameter and larger, and will permit particles having a diameter of less than five microns and also fluid to flow through the patch 30.

A patch cover 32 provides access through the case or housing 12 to the patch 30. The patch can be exchanged once used through the patch cover 32. The patch 30 when installed in the tester 10 is held securely in place in the fluid path 20. An old patch that has tested fluid can be removed via the patch cover 32 and a new, fresh patch 30 can be inserted into the fluid path 20 via the patch cover 32 in a suitable manner for conducting the patch test.

After the lubricating or hydraulic fluid has flown through the patch 30, it will continue along the fluid path 20 to an outlet 34. The outlet 34 is covered by an outlet cover or cap 36. The outlet cover or cap 36 may be attached to the outlet 34 via threads, snap fit or any suitable method of securing the outlet cap 36 to the outlet 34. In some embodiments of the invention, the fit between the outlet cap 36 and the outlet 34 seals sufficiently so that lubricating or hydraulic fluid does not leak through the outlet 34 when the outlet cap 36 is in place.

In some embodiments of the invention, once the fluid has flown through the fluid path 20 and exited out of the outlet 34, the fluid path 22 may be cleaned by running a solvent fluid or cleaning fluid through the fluid path 22. The solvent or cleaning fluid is used to clean out the fluid path 22 and prepare the fluid path 22 for conducting other tests on other fluid. Any suitable cleaning fluid may be used in accordance with the invention including those currently used in current patch tests.

In some embodiments of the invention, the lubricating fluid is diluted before flowing through the patch 30. Diluting the lubricating or hydraulic fluid may be accomplished by adding a diluting agent or solvent to the lubricating or hydraulic fluid. The diluting agent in some embodiments of the invention is the same fluid as the cleaning fluid. Any suitable fluid may be used in accordance with the invention.

One reason why the lubricating or hydraulic fluid is diluted is to facilitate movement of particles that are attracted or repelled by the charged walls 26 when otherwise these particles would move extremely slowly due to the thick viscosity of the lubricating or hydraulic fluid. In other embodiments of the invention, adding addition of a dilution fluid to the lubricating or hydraulic fluid is not necessary. In some embodiments of the invention, the diluting agent is added to the lubricating or hydraulic fluid on a 1:1 ratio, or in other words, one ounce of diluting fluid is added for every ounce of lubricating or hydraulic fluid to be tested.

In some embodiments of the invention, the tester 10 is configured to permit flow and testing of approximately one half to five ounces of fluid. In other embodiments of the invention, other amounts of fluid can be tested. Dimensions for the tester 10 may be selected by one skilled in the art according to how much fluid is desired to be tested.

In some embodiments of the invention, the patch 30, itself after it has been used to test lubricating fluid, can be cleaned and reused by flowing diluting fluid or solvent through the patch 30 or soaking the patch 30 in a diluting fluid or solvent. In some embodiments of the invention, agitating the patch 30 in the solvent will facilitate in cleaning it and permitting it to be used again.

Figure 2:
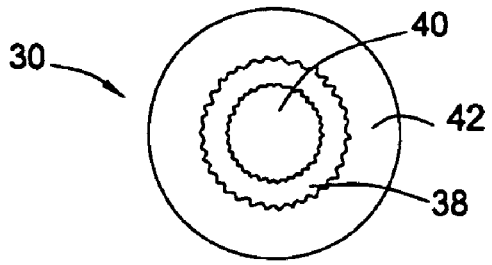
FIG. 2 is a top view of a patch that has fluid flown through it in the fluid testing apparatus of FIG. 1.

Turning now to FIG. 2, a patch 30 that has tested a lubricating or hydraulic fluid is illustrated. A patch 30 that has tested a lubricating or hydraulic fluid will show several regions having different colors. These regions are materials that have been filtered out by the patch 30 in the FIG. 2. In a patch 30 that has been used in a tester 10, as described herein, it is anticipated that at least three regions of different colors will be seen on the patch 30. In FIG. 2, as illustrated, there are three regions 38, 40 and 42 illustrated as exemplary.

For example, the region identified as 40 in FIG. 2, will be concentrated with negatively charged particles. Because the patch 30 is located in a negatively charged chamber 28, the negatively-charged particles will tend to concentrate towards the center of the magnetization chamber 28. It is anticipated that the materials concentrating in the center portion of the patch 30 would be negatively charged. These particles include steel, iron, nickel, copper, silicon, dust and dirt because these materials prefer to accept electrons and becoming negatively charged. In addition, in embodiments equipped with a magnet 33 steel, iron and other Ferris materials will tend to concentrate where magnet 33 is located. If there are a lot of copper colored particles this region may appear gold or copper colored. If there are a lot of iron particles, this region may appear dark colored.

In the region of the patch 30 identified by reference numeral 42, it is anticipated that this region 42 will have a higher concentration of materials that tend to become positively charged when subjected to the ionization chamber 22 as described herein. As anticipated, the materials that may tend to concentrate in the regions identified in 42 would include aluminum, lead and other particles that tend to become positively charged when subjected to an ionization chamber 22 as described herein. This region may appear grey or silver colored.

These positively charged particles will tend to gravitate in the fluid closest to the proximity to the negatively-charged, walls 26 of the charge chamber 28 because they are positively charged and will be attracted to the negatively charged walls 26. The materials concentrated in both regions 40 and 42 are wear materials or in other words materials that are suspended in the lubricating fluid because they have worn off in the machinery that is being lubricated by the lubricating fluid.

In the region identified in FIG. 2 as 38, it is anticipated that here the color of this region would contain materials such as carbon, water, microbes, etc. which do not tend to become positively or negatively charged when subjected to an ionization chamber 22 as described herein. These particles may appear brown or red. Of course, the region 38 would not be the only place where these materials would be found, but they would be found throughout the patch because they are not biased to move towards the outer edge, the center of the patch 30, or the area in between.

Likewise, materials that tend to be concentrated towards the center of the patch in region 40 or the outer periphery of the patch in region 42, will likewise be typically found in all areas of the patch 30. However, it is anticipated that due to the charged chamber 28, materials will tend to concentrate towards either the center of the patch 30, in the case of negatively-charged materials, or to the outer periphery of the patch 42 in the case of positively-charged materials.

In some embodiments of the invention the patch may be analyzed by a microscope. In accordance with the invention the microscope may be a two power microscope. Of course other suitable powered microscope may be used in accordance with the invention. In some embodiments of the invention the microscope is portable and is taken into the field for analyzing the patch 30 when the patch tester 10 is used.

Figure 3:
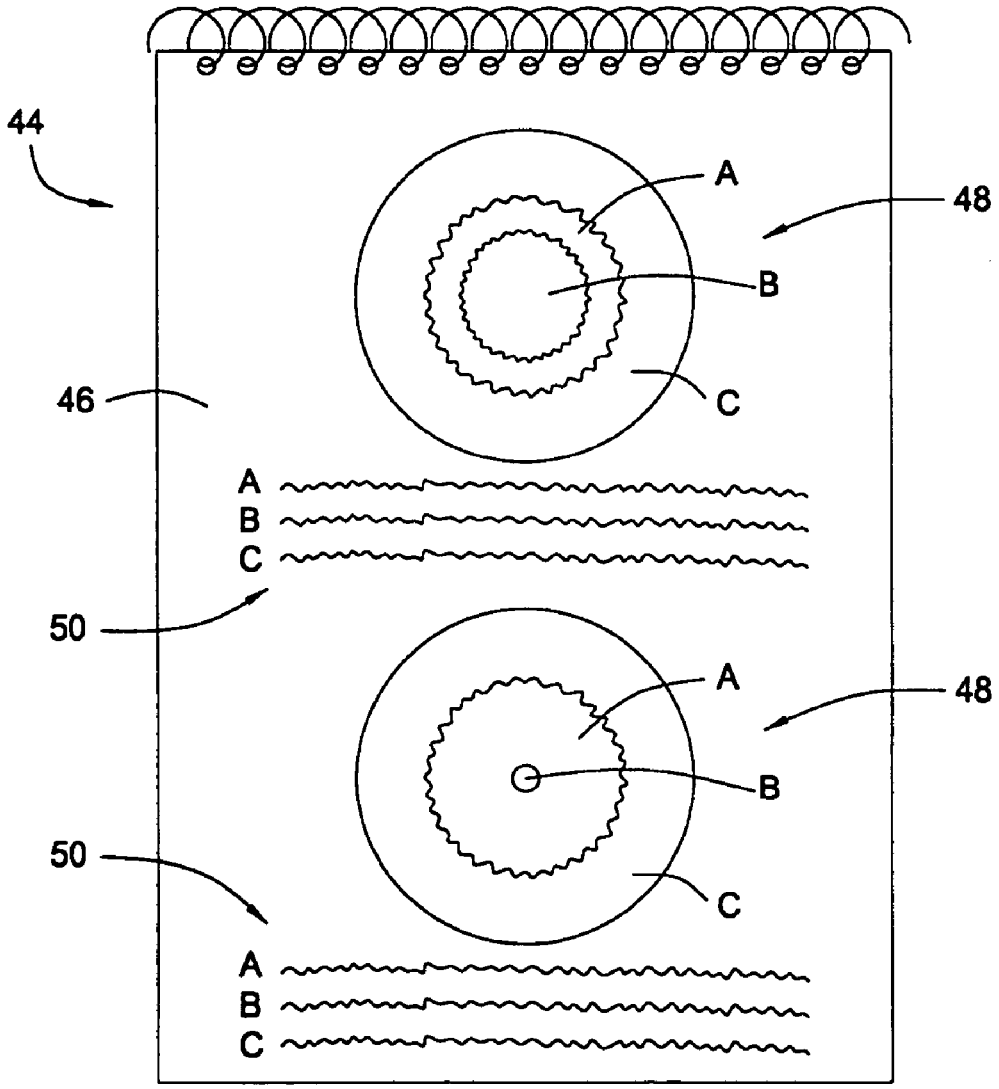
FIG. 3 is a top view of a book illustrating what patches will look like when fluids having various characteristics have flow through them in a fluid testing apparatus as shown in FIG. 1.

FIG. 3 is an illustration of an exemplary guidebook 44. In some embodiments of the invention, as illustrated in FIG. 3, the guidebook 44 can be a spiral-bound book. In other embodiments of the invention, the guidebook 44 can be a fold-out booklet. Other suitable books or booklets may be used in accordance with the invention.

The guidebook 44 may have pages 46 with exemplary illustrations 48 of patches 30. The guidebook 44 can have color or black or white illustrations 48 with different regions a, b and c, identified on the illustrated patches 48. Other embodiments of the invention include an illustration having more or less regions illustrated on the patches 48. The guidebook 44 can also contain written descriptions 50 correlating colors or strata regions on the patches 48 with various contaminants in the tested fluid. The guidebook 44 can also include instructions on how to maintain the equipment based on what the tested patch 30 looks like compared to the illustrated pages 48 thus, enabling a user of the tester 10. In some embodiments of the invention, the guidebook provides illustrated patches 48 that are examples of magnified patches 30 as viewed by a microscope.

While the tester 10 has been described as testing a lubricating or hydraulic fluid, it is appreciated that it can be used to test and any number of different fluids.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A fluid tester comprising:

an inlet for a fluid path;

an ionization chamber defining at least part of the fluid path located downstream of the inlet;

a charge chamber configured to subject a fluid to an electric field defining at least part of the fluid path located downstream of the ionization chamber;

a patch holder configured to hold a patch into the fluid path downstream of the charge chamber; and an outlet for the fluid path.

2. The fluid tester of claim 1, further comprising a pump located along the fluid path and configured to pump fluid along the fluid path.

3. The fluid tester of claim 2, wherein the pump is a hand pump.

4. The fluid tester of claim 2, further comprising a magnet located in the fluid path between the patch holder and outlet.

5. The fluid tester of claim 1, wherein the charge chamber is configured to cause walls of the charge chamber to be negatively charged.

6. The fluid tester of claim 1, wherein the ionization chamber is configured to subject fluid in the ionization chamber to a high voltage.

7. The fluid tester of claim 1, wherein the ionization chamber is configured to subject fluid in the ionization chamber to ultra violet radiation.

8. The fluid tester of claim 1, wherein the ionization chamber is configured to subject fluid in the ionization chamber to static electricity.

9. The fluid tester of claim 1, further comprising a patch located in the patch holder.

10. The fluid tester of claim 9, wherein the patch will strain objects of at least 5 microns.

11. The fluid tester of claim 1, further comprising a housing containing the ionization chamber, the charge chamber and the patch holder.

12. The fluid tester of claim 11, further comprising a handle attached to the housing.

13. The fluid tester of claim 1, further comprising a patch template illustrating and explaining an exemplary patch that has had fluid flowed through it in a fluid tester.

14. A fluid tester, comprising:

means for inletting a fluid into a fluid path;

means for ionizing fluid located downstream of the inletting means;

means for creating an electric field in the fluid path located downstream of the ionizing means;

means for holding a patch configured to hold a patch into the fluid path downstream of the means for creating an electric field; and means for outletting fluid from the fluid path.

15. The fluid tester of claim 14, further comprising a magnet located in the fluid path between the means for holding a patch and the means for outletting fluid.

16. The fluid tester of claim 14, further comprising means for describing a condition of a fluid flowing through the fluid path by illustrating a patch.

* * * * *

UNITED STATES PATENT AND TRADEMARK OFFICE

CERTIFICATE OF CORRECTION

PATENT NO. : 7,797,986 B2
APPLICATION NO. : 11/511399
DATED : September 21, 2010
INVENTOR(S) : Charles E. Kinkade, Jr. and Thomas R. Taylor It is certified that error appears in the above-identified patent and that said Letters Patent is hereby corrected as shown below:

Title Page, item (54) and col. 1, line 1, replace title of "Magnetic Fluid Particulate Separation Process" with --Magnetic Fluid Particulate Matter Separation Process--.

Signed and Sealed this
Seventeenth Day of May, 2011

David J. Kappos

David J. Kappos
*Director of the United States Patent and Trademark Office*